US012077716B2

(12) United States Patent
A/L Suppiah et al.

(10) Patent No.: US 12,077,716 B2
(45) Date of Patent: Sep. 3, 2024

(54) SYSTEM FOR RECOVERING NATURAL GAS LIQUID FROM LOW PRESSURE SOURCE AT LOW TEMPERATURES

(71) Applicant: NGLTech Sdn. Bhd., Kuala Lumpur (MY)

(72) Inventors: Arul Jothy A/L Suppiah, Kuala Lumpur (MY); Boon Lee Ooi, Kuala Lumpur (MY); Ching Liang Chen, Kuala Lumpur (MY); Ebtehal Eisa Regheb Eisa Farag, Kuala Lumpur (MY); Dhanaraj A/L Turunawarasu, Kuala Lumpur (MY)

(73) Assignee: NGLTECH SDN. BHD., Kuala Lumpur (MY)

( * ) Notice: Subject to any disclaimer, the term of this patent is extended or adjusted under 35 U.S.C. 154(b) by 344 days.

(21) Appl. No.: 17/439,034

(22) PCT Filed: Mar. 13, 2020

(86) PCT No.: PCT/MY2020/050014
§ 371 (c)(1),
(2) Date: Sep. 14, 2021

(87) PCT Pub. No.: WO2020/185066
PCT Pub. Date: Sep. 17, 2020

(65) Prior Publication Data

US 2022/0154080 A1 May 19, 2022

(30) Foreign Application Priority Data

Mar. 14, 2019 (MY) ..... PI2019001292

(51) Int. Cl.
*C10G 5/06* (2006.01)
*C10L 3/10* (2006.01)

(52) U.S. Cl.
CPC ..... *C10G 5/06* (2013.01); *C10L 3/101* (2013.01); *C10L 3/107* (2013.01);
(Continued)

(58) Field of Classification Search
CPC ... C10G 5/06; C10L 3/101; C10L 3/10; C10L 3/107; C10L 2290/08; C10L 2290/10;
(Continued)

(56) References Cited

U.S. PATENT DOCUMENTS 3,393,527 A * 7/1968 Swenson ..... F25J 3/0247 568/918
4,356,014 A * 10/1982 Higgins ..... F25J 3/062 62/622

(Continued)

FOREIGN PATENT DOCUMENTS

| | | |
|---|---|---|
| CA | 910184 | 9/1972 |
| WO | WO2015183072 | 12/2015 |
| WO | WO2018012959 | 1/2018 |

*Primary Examiner* — Kun Kai Ma
(74) *Attorney, Agent, or Firm* — Head, Johnson, Kachigian & Wilkinson, PC

(57) ABSTRACT

A system for recovering natural gas liquid from a gas source, comprising compression means (206) for increasing the temperature and pressure of the fluid from the gas source, cooling means (230) for cooling the fluid from the compression means, a gas/gas heat exchanger (204), fluid from the gas source flowing from a first inlet to a first outlet; at least one separator (208) for receiving the fluid from the first outlet of the gas/gas heat exchanger (204) and separating liquid from the gas, the gas from the separator being directed to expansion means (206) for reducing the temperature and pressure of the gas, the aqueous part of the liquid from the separator and/or the gas from the expansion means being directed to the gas/gas heat exchanger (204) where it flows therethrough from a second inlet to a second outlet for cooling the fluid flowing between the first inlet and first
(Continued)

outlet, wherein injection means are provided between the cooling means and the gas/gas heat exchanger for saturating the gas with a liquid agent, wherein the liquid agent comprises an evaporant and an antifreeze agent; and a recovery vessel (240) is provided downstream of the second outlet, the antifreeze agent being recovered therein for injection into the fluid from the gas source upstream of the first inlet.

8 Claims, 4 Drawing Sheets

(52) U.S. Cl.
CPC ..... *C10L 2290/08* (2013.01); *C10L 2290/10* (2013.01); *C10L 2290/141* (2013.01); *C10L 2290/46* (2013.01); *C10L 2290/48* (2013.01); *C10L 2290/545* (2013.01)

(58) Field of Classification Search
CPC ..... C10L 2290/141; C10L 2290/46; C10L 2290/48; C10L 2290/545; C10L 2290/14; C10L 2290/54; C10L 2290/543; C10L 2290/04; C10L 2290/12
See application file for complete search history.

(56) References Cited

U.S. PATENT DOCUMENTS

| | | | | |
|---|---|---|---|---|
| 4,410,342 | A | 10/1983 | Horton | |
| 4,522,636 | A * | 6/1985 | Markbreiter | F25B 9/06 62/402 |
| 7,637,122 | B2 * | 12/2009 | Turner | F25J 1/0052 62/611 |
| 9,724,637 | B2 | 8/2017 | Li et al. | |
| 2012/0060528 | A1 | 3/2012 | Takeda et al. | |
| 2012/0160103 | A1 | 6/2012 | Suppiah et al. | |
| 2015/0210936 | A1 * | 7/2015 | Burgers | F25J 3/0209 196/46 |
| 2019/0225891 | A1 * | 7/2019 | Suppiah | C10L 3/12 |

* cited by examiner

SYSTEM FOR RECOVERING NATURAL GAS LIQUID FROM LOW PRESSURE SOURCE AT LOW TEMPERATURES

FIELD OF INVENTION

The invention relates to a system for recovering natural gas liquid from a low pressure source at low temperatures.

BACKGROUND

A natural gas stream often contains light hydrocarbons. Natural gas liquids (NGL) is the general term for liquids extracted from the natural gas stream (ethane and heavier products) and within this liquefied petroleum gas (LPG) is the term used to refer to extracted liquids where the main components are propane, n-butane and iso-butane.

Low pressure hydrocarbon gases particularly associated gas from oil and gas production facilities pose significant challenges for operators worldwide as typically the facilities are stranded with lack of infrastructure to route the produced gas. In addition, being at low pressure, the cost associated with the additional compression facilities very often makes it uneconomical to monetize the gas. Decline in well pressures of mature fields also makes it challenging to install additional compression facilities to boost pressure of produced gas. As a result, in many facilities, the associated gas produced is utilized as fuel gas while the balance is being flared. The often overlooked feature of low pressure gas from producing wells is that being at low pressure the vapor liquid equilibrium of the production fluid favours higher content of C4+ components in the gas phase, resulting in richer gas being used as fuel gas or flared. This results in significant amount of C4+ components which can be recovered as condensates being flared. For low pressure gas, it is estimated that for each MMscf of gas, recoverable condensates are in the order of 30 bbls to 100 bbls (MMscf=millions of standard cubic feet; bbls=barrels).

In addition, recovery of these condensates from the gas stream is expected to reduce $CO_2$ emissions due burning as fuel gas or flaring by up to 30% which is in line with the recent Paris Agreement within the United Nations Framework Convention on Climate Change dealing with GHG (Green House Gas) emission mitigation and adaptation starting in 2020 by decreasing the carbon footprint in the flared gas. An ambitious target has been set to curb the increase in global average temperatures to well below 2° C. above pre-industrial levels and to pursue efforts to limit this to 1.5° C. and ultimately net-zero GHG emissions by 2100.

Removal of NGLs from natural gas is desirable for the following reasons:

- Production of what is known as 'pipeline quality' dry natural gas. Major transportation pipelines usually impose restrictions on the make-up of the natural gas that is allowed into the pipeline. That means that before the natural gas can be transported it must be purified. Typically, this involves meeting a dew-point specification of the gas pipeline and will include the removal of C4+ components from the gas stream.
- In cases, where the natural gas is burned as fuel gas or flared, to meet fuel gas calorific value/Wobbe index value, dew-point specifications and to minimize $CO_2$ emissions (during flaring or burning as fuel) it is desirable and/or essential for NGLs to be removed from natural gas.
- NGLs include ethane, propane, butane, iso-butane, and natural gasoline, and can be very valuable by-products of natural gas processing. These NGLs are sold separately and have a variety of different uses; including enhancing oil recovery in oil wells, providing raw materials for oil refineries or petrochemical plants, and as sources of energy.

Depending on the requirement, hydrocarbon dew point control packages or cryogenic plants can be used to extract NGL from gas streams. Hydrocarbon dew point refers to the temperature at any pressure range or the pressure at any temperature range where hydrocarbons begin to condense from the gas mixture.

There are various types of Hydrocarbon Dew Point Control (HCDPC) units available in the market to extract NGL (Natural Gas Liquid) from a natural gas stream (associated or non-associated gas). The following is a brief review of the methods used to reduce hydrocarbon dew point in gas streams. As these processes are well known, for the sake of brevity, process descriptions are not included as they are well covered in the literature:

1) Low Temperature Separation (LTS)

If the raw gas is at high pressure, the removal of hydrocarbons can be accomplished by refrigeration obtained through the expansion of gas by means of a Joule-Thomson (JT) valve. Injection of glycol is required to prevent the formation of hydrates. However, if the raw feed gas pressure is low, condensate recovery is poor due to the small change in pressure achievable and hence the low JT effect. In addition, recovery of the glycol requires additional apparatus, such as a reboiler, a condenser and a reflux column. External utilities like hot oil and cooling water are required to operate both the reboiler and condenser.

2) Turbo-Expander Dew Point

This process is a variation of the LTS process in which the energy pressure held in the gas is used to move an expander turbine, which in the isoentropic expansion generates refrigeration and exports mechanical work. This work is used to drive a compressor to partially restore the gas pressure. Here again, the raw feed gas pressure has to be relatively high to generate adequate chilling for NGL recovery.

3) Refrigeration

The most common method used for gas dew point control is mechanical refrigeration. This technology is suited especially when pressure is not available to be used to self-refrigerate the gas. Mechanical refrigeration system however are bulky and expensive which includes compression equipment and power consumption.

4) Adsorption

This method uses adsorbents like silica gel that have the capability to adsorb heavy hydrocarbons. The system is set up in multiple beds cycling in short operating cycles of adsorption, desorption, of approximately 20 minutes. This method was well used in the 60s and early 70s and was gradually abandoned. Recently, new adsorption materials are making this method economically attractive for certain project applications. However, these adsorbent again typically operate effectively with higher feed gas pressures with regeneration and recovery of NGLs being undertaken at lower pressure and higher temperatures.

5) Static Expansion Devices

The Vortex-Tube Device and the Supersonic Tube technology. For these devices also require high pressure gas for the system to generate adequate chilling of the gas stream for NGL extraction.

6) Membranes

Silicon rubber membranes, for example, have the ability to permeate heavy hydrocarbons rather than light. This makes them a potential candidate for dew point control.

However, these systems require some amount of pre-treatment to protect the membranes and compression of the permeate stream to minimize NGL losses. In addition, to be economically viable, these systems require relatively high inlet gas pressures.

As can be seen from the preceding discussions, whilst there are many NGL recovery systems by means of various types of HCDPC units, these are only really suitable for feed gas streams that operate at relatively high pressures. In addition, the refrigeration systems that can handle low pressure feed gas streams, are very bulky, complex and costly, making them economically not viable for many low pressure applications.

There are many facilities where natural gas is produced at low pressures of between 3 to 20 barg and these include:

- Associated gas from oil and gas production facilities which typically operate between 3 to 15 barg at the inlet to the receiving facilities. In many cases, the associated gas is an undesirable by-product that is utilized as fuel gas with the balance flared, along with valuable NGLs as it is un-economical to extract.
- NGLs are an excellent enhanced oil recovery (EOR) solvent. However, the cost of extracting NGLs from low pressure associated gas makes this option for EOR not viable in many cases.
- Non-associated gas production reservoirs in many cases are abandoned when flowing pressures decline below 10 barg as it becomes uneconomical.
- Low pressure off-gas from various sources like the refinery or Petrochemicals Complex in many cases are either used as fuel gas or flared. There is an increased demand to install NGL extraction to recover valuable NGLs and in return send the clean fuel gas for burning.
- Vents from FPSOs, crude transportation tankers and storage tanks are typically vented along with valuable NGLs that vaporize from the crude stored in the tanks. Apart from the environmental impact of venting, there is significant revenue loss due to shrinkage of crude volumes due to these vaporization losses.

The installation of HCDPC units for NGL extraction from low pressure natural gas has both the economic and environmental benefits as the main polluting components from the off gas are separated and the value added products like lean natural gas and NGL are produced. The burning of methane rich gas produced from this unit without polluting and soot forming components is beneficial from an environmental point of view.

While it is noted that NGLs constitute a small fraction of natural gas from wells and various other sources, however its contribution towards greenhouse gas emissions is significant when the gas is burnt as fuel gas or flared. Typically, $CO_2$ emissions can be reduced by approximately 30% with extraction of NGLs from the gas. It is more significant for low pressure natural gas as the vapour liquid equilibrium favours vaporization of heavy ends into the gas phase resulting in higher content of NGLs in the gas stream. Ironically though, it is the low pressure natural gas streams that are typically disposed as fuel gas or flared as is uneconomical to recover.

The above clearly indicates that the Industry is presently striving for a new flexible, reliable and a safe process that can cost effectively extract NGLs from low pressure natural gas.

Utilising a JT Valve located downstream of the Cold Separator helps to maximise liquid drop-out from the associated gas stream for low operating pressures of the associated gas. However, at operating pressures below the cricondentherm, the temperature and/or pressure may have to be reduced more significantly to cause liquid drop-out (required for the separator to work), but as a result hydrates may form and cause blockages. An aim of the invention therefore is to provide a system for recovering NGLs which operates effectively with a low pressure source of natural gas.

SUMMARY OF INVENTION

In an aspect of the invention, there is provided a system for recovering natural gas liquid from a gas source, comprising:

- compression means for increasing the temperature and pressure of the fluid from the gas source;
- cooling means for cooling the fluid from the compression means;
- a gas/gas heat exchanger, fluid from the cooling means flowing from a first inlet to a first outlet;
- at least one separator for receiving the fluid from the first outlet of the gas/gas heat exchanger and separating liquid from the gas;
- the gas from the separator being directed to expansion means for reducing the temperature and pressure of the gas;
- the aqueous part of the liquid from the separator and/or the gas from the expansion means being directed to the gas/gas heat exchanger where it flows therethrough from a second inlet to a second outlet for cooling the fluid flowing between the first inlet and first outlet;
- wherein injection means are provided between the cooling means and the gas/gas heat exchanger for saturating the gas with a liquid agent;
- characterised in that the liquid agent comprises an evaporant and an antifreeze agent; and
- a recovery vessel is provided downstream of the second outlet, the antifreeze agent being recovered therein for injection into the fluid from the gas source upstream of the first inlet.

Advantageously the upstream compression of the gas allows a larger cooling effect over the heat exchanger due to the greater pressure drop (the JT effect) and thus condensate recovery is improved.

Advantageously the antifreeze agent prevents blockages by ensuring hydrates do not form, and self-regenerates within the system to prevent loss thereof In one embodiment the antifreeze agent is monoethylene glycol (MEG). In a further embodiment the antifreeze agent is monopropylene glycol (MPG).

In one embodiment the evaporant is water. However it will be appreciated that other liquids e.g. propane may be used as a suitable evaporant depending on the temperature and pressure conditions.

In one embodiment the separator is provided with a heater for de-emulsifying the liquid in the separator. Typically the heater is located in a separate vessel which receives liquid from the bottom of the separator, warms the liquid, then returns the liquid to the separator.

The bottom section of the cold separator will collect both the recovered condensate and rich MEG. These two liquids are immiscible and will settle down in the bottom section of the separator to form two distinct phases for separation. However, under cold conditions (<15° C.), a MEG/Condensate emulsion forms. The separation of recovered condensate and MEG is very poor due to high viscosity. Emulsion formation is favoured by low temperature (<15° C.) and high MEG concentration. By increasing the liquid temperature above 15° C. the viscosity is reduced and the emulsion is broken down.

The configuration is analogous to the kettle reboiler, where the liquid (recovered condensate and MEG-water mixture) contained in the bottom of the cold separator is withdrawn and warmed up to a higher temperature (>15° C.). The fluid is then recycled back to the cold separator where the separation for recovered condensate and MEG-water mixture takes place.

In one embodiment the expansion means is a Joule-Thomson valve. In another embodiment the expansion means and compression means are provided by respective sides of a turbo expander. In yet another embodiment, the expansion means is a Static Expansion Device such as a Vortex-Tube Device or Supersonic Tube technology.

Typically the expansion means reduces the pressure of the gas and as a result reduces the temperature thereof.

In a conventional system the JT valve or other expansion means is upstream of the separator. When the gas source is at high pressure a large pressure drop can take place at the JT valve resulting in a large reduction in temperature. However, for low pressure gas sources only a small pressure drop can take place, so the reduction in temperature is smaller. Thus in a conventional system adequate chilling for condensate recovery cannot be generated from low pressure gas sources.

However, in the present invention the JT valve or other expansion means is downstream of the separator. The condensate recovery is done at the supplied raw gas pressure (or higher followed by the compression in the turbo-expander) before the isentropic expansion takes place via the JT valve or other expansion devices downstream of the separator to attain the cold energy. This configuration will help to move the operating point of the cold separator to a higher quality line value for better liquid dropout. Liquid evaporant such as water is injected to increase the enthalpy of the expanded-chilled-dry gas, reducing the temperature of the raw feed gas further by the evaporative cooling means thereof to achieve the required low temperatures for a more effective and higher condensate recovery compared to a conventional system even for low pressure gas sources.

In one embodiment the cooling means is a seawater or air cooler, which does not significantly change the pressure of the fluid.

In one embodiment the gas/gas heat exchanger comprises a series of heat exchangers and/or a multi-section heat exchanger comprising independent compartments within the same closure.

In one embodiment the gas from the second outlet may be flared off.

In one embodiment the liquid separated in the separator comprises an aqueous part and a condensate. Typically the condensate comprises hydrocarbons (including NGL), which are directed to an outlet for further treatment. Typically the aqueous part comprises the liquid agent. Thus the hydrocarbons are separated from the aqueous liquid by de-emulsification.

In one embodiment the condensate from the separator is spiked into a surge vessel, provided for separating gas, water and oil at low pressure, the condensate being directed through a column of material through which gas from the surge vessel passes in the opposite direction to strip off C3– components from the condensate and recover heavy ends from the gas.

BRIEF DESCRIPTION OF DRAWINGS

It will be convenient to further describe the present invention with respect to the accompanying drawings that illustrate possible arrangements of the invention. Other arrangements of the invention are possible, and consequently the particularity of the accompanying drawings is not to be understood as superseding the generality of the preceding description of the invention.

DETAILED DESCRIPTION

Hydrocarbon Dew Point Control (HCDPC) of low pressure gas uses the concept of evaporative cooling, coupled with a gas expansion device which may either be a JT Valve, Static Expansion Devices or a Turbo-Expander, to chill the gas stream to condense and remove the heavier hydrocarbon components (NGLs) from the natural gas stream.

Evaporative cooling is the addition of water vapor into gas that is water dew pointed, which causes lowering the temperature of the gas. The energy needed to evaporate the water is taken from the gas in the form of sensible heat, which reduces the temperature of the gas, and converted into latent heat, the energy present in the water vapor component of the gas, whilst the gas remains at a constant enthalpy value. This conversion of sensible heat to latent heat is known as an adiabatic process because it occurs at a constant enthalpy value. Evaporative cooling therefore causes a drop in the temperature of gas proportional to the sensible heat drop and an increase in humidity (or water vapor content) of the gas proportional to the latent heat gain.

A simple example of natural evaporative cooling is perspiration, or sweat, secreted by the body, evaporation of which cools the body. The amount of heat transfer depends on the evaporation rate, however for each kilogram of water vaporized 2257 kJ of energy at 35° C. are transferred. The evaporation rate depends on the temperature and humidity of the air, which is why sweat accumulates more on humid days, as it does not evaporate fast enough.

The evaporative cooling medium as used in this invention is typically fresh (demineralized) water but may be any medium that achieves vaporization in the gas stream to convert sensible heat in the gas to latent heat of vaporization of the medium.

It is also noted that the description of the system as detailed in this document are mainly applicable for low pressure systems, where typically water is used as the evaporative medium, the concept as detailed here may also be used for high operating pressure systems with a suitable alternative evaporative medium.

Figure 1:
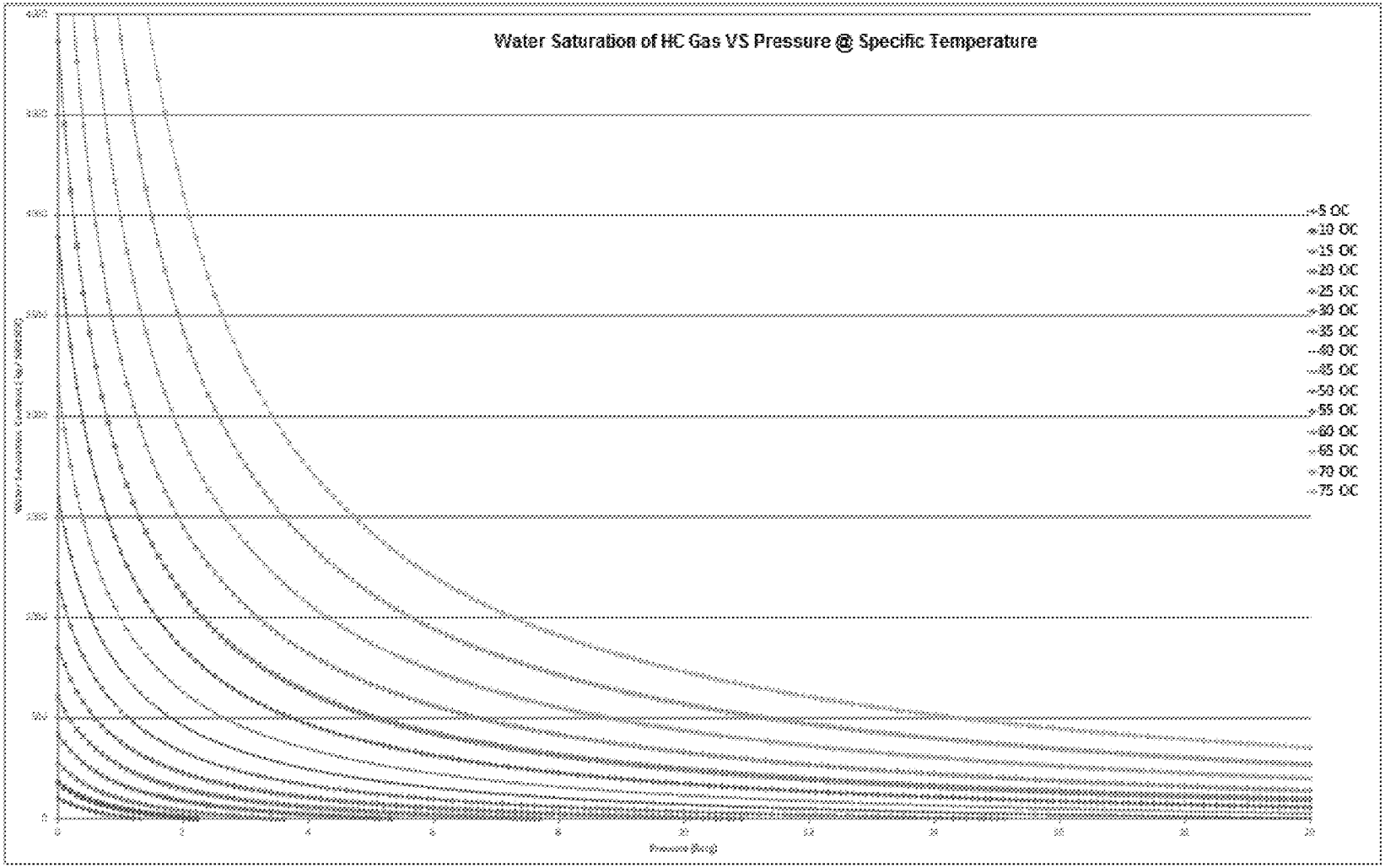
FIG. 1 is a graph of water saturation of HC gas against pressure at different temperatures.

In the case where water is used as an evaporative medium, this concept is particularly suited for low pressure gas stream which does not have enough upstream pressure to chill the gas on expansion through either a JT Valve, Static Expansion Devices or a Turbo-Expander (or a combination). It is noted that, typically on expansion of low pressure gas, the water dew point of the expanded (lower pressure) gas is significantly lowered. This is because at low pressures (around less than 20 barg), the saturation water content of gas increases exponentially as the gas pressure is lowered (at constant temperature). This fact is demonstrated in FIG. 1.

Figure 2:
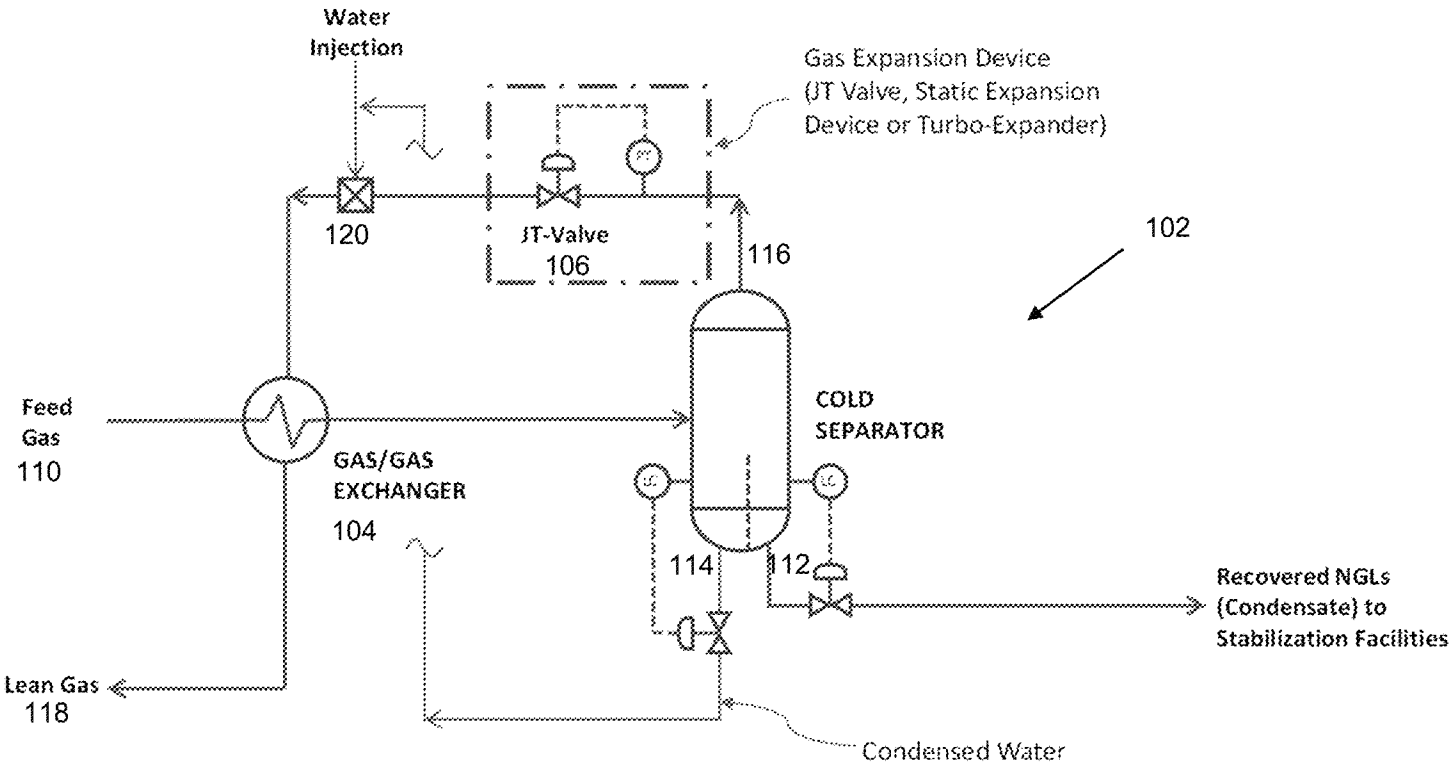
FIG. 2 illustrates a known NGL recovery system.

FIG. 2 illustrates an NGL recovery system 102 which comprises a gas/gas heat exchanger 104, a separator 108, and a JT valve 106 located downstream of the separator 108. In addition, a liquid injection system 120 is provided downstream of the JT valve to increase the enthalpy of the expanded-chilled-dry gas, reducing the temperature of the raw feed gas further by the evaporative cooling mean thereof could achieve the required low temperatures for an effective and higher condensate recovery compared to a conventional system even for low pressure gas sources 110. The separator provides gas, NGL and water to respective outlets 116, 112, 114, and the water therefrom may be used as a water supply for the liquid injection means. The lean gas is directed towards the flare point 118.

In more detail:

Feed gas 110 from the upstream production facility is routed to a Gas-Gas Exchanger 104. The hot feed gas stream is chilled by the cold gas stream from the JT-Valve 106. Other gas expansion device could be static expansion device or turbo-expander.

The chilled feed gas stream is then routed to the Cold Separator 108 where 3 phase gas-oil-water separation is undertaken.

The separated gas is routed to the JT-Valve 106, the oil phase to the downstream NGL processing facilities 112 and the aqueous phase 114 is re-injected 120 into the gas stream downstream of the JT-Valve 106.

The expanded and chilled gas from the JT-Valve 106 is then routed to the Gas-Gas Exchanger 104 for heat cross exchange to chill the incoming feed gas stream. Prior to routing to the Gas-Gas Exchanger, condensed water from the Cold Separator with make-up of fresh water is injected 120 into the gas stream from the JT-Valve. In addition, the heated and water saturated gas downstream of the Gas-Gas Exchanger may be cooled and the condensed water removed and recycled for injection upstream of the Gas-Gas Exchanger. This will potentially avoid the need for make-up Fresh Water.

At the Gas-Gas Exchanger 104, the chilled gas increases in temperature (i.e. is superheated) by the incoming hot feed gas stream and simultaneously evaporation of the injected aqueous medium in the cold side of the exchanger occurs. To maximize the cooling duty of the exchanger (and thus minimize the hot feed gas stream outlet temperature), the injection rate of the condensed and fresh water make-up is set to saturate the cold side gas at its outlet conditions. An excess amount may be injected beyond its saturation point to ensure that TDS content of the aqueous phase does not exceed its saturation point to avoid solid deposition at the Gas-Gas Exchanger 104.

From the Gas-Gas Exchanger 104, the heated gas stream is routed to the downstream gas facilities.

As the JT Valve is located downstream of the Cold Separator, liquid drop-out from the associated gas stream for low operating pressures of the associated gas is maximised. This is due to the fact that the operating point will move toward a higher quality line within the phase envelope.

Figure 3:
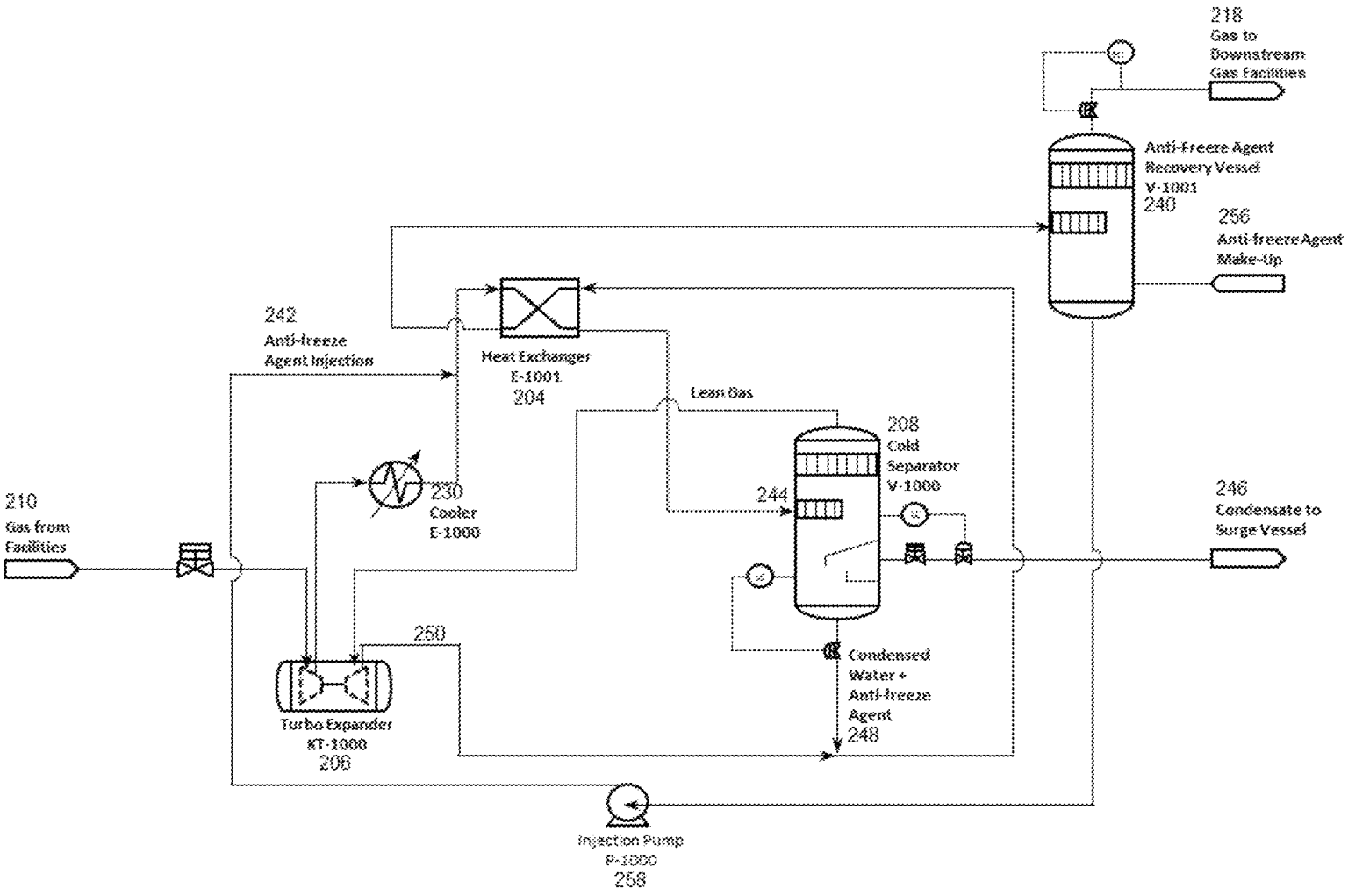
FIG. 3 illustrates an NGL recovery system according to an embodiment of the invention.
Figure 4:
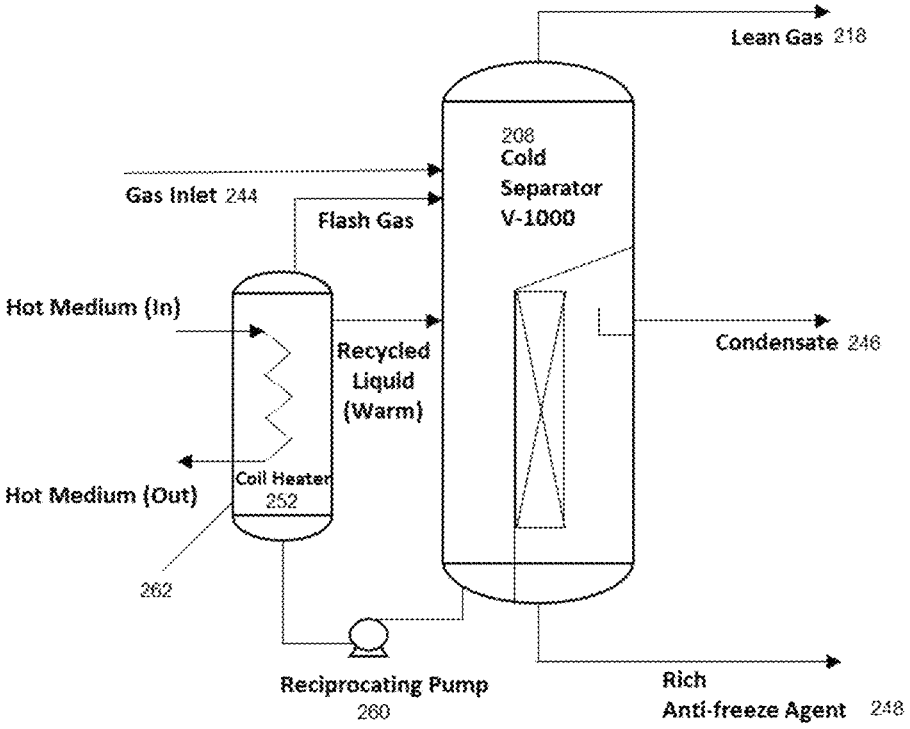
FIG. 4 illustrates a cold separator with a heater for emulsion treatment.

With regard to FIG. 3, an embodiment of the invention is illustrated which addresses this issue. The following describes the configuration of the system, herein referred to as LP-CRS:

1. Feed gas 210 from the upstream production facility, which may have a temperature in the range of 30-55° C. and pressure of less than 10 barg, is routed to the compressor side of the turbo-expander 206 (KT-1000) which is driven by the turbo-expander. The gas is then compressed thereby increasing the temperature to around 70-100° C. and pressure of around 14-15 barg, before being routed to the compressor discharge cooler 230 (E-1000) where it is cooled by seawater or air to around 40° C. without significant reduction in pressure.
2. The gas is then routed to a single pass multi-section heat exchanger 204 (E-1001) where it is gradually chilled to the temperature within the approximate range of −20° C. to −45° C. The low pressure cool gas leaving the turbo-expander 206 (KT-1000) and cold fluid leaving the Cold Separator 208 (V-1000) may be used as cooling medium for heat exchanger 204 (E-1001).
3. A glycol-based anti-freeze agent such as Monoethylene Glycol (MEG) from Recovery Vessel 240 (V-1001) is injected 242 into the gas stream leaving the cooler 230 (E-1000), prior to the heat exchanger 204 for hydrate inhibition and as an anti-freeze agent to enable the system to perform at lower temperatures in order to maximize condensate recovery.
4. The cold gas stream 244 from the heat exchanger 204 (E-1001) is then routed to the Cold Separator 208 (V-1000) for three phase separation. Recovered condensate 246 is stabilized first before spiked into the existing Surge Vessel in the processing facility. Cold lean gas is routed to the expansion side of the turbo expander 206. The cold condensed water 248 with the glycol-based anti-freeze agent is injected into the low pressure cool gas stream 250 leaving the expansion side of the turbo expander 206 (KT-1000). The injection of condensed water into this cool gas stream, now at a temperature of around −85° C. to −90° C. and pressure of about 2-3 barg, enables further cooling of the gas stream entering the cold separator 208 (V-1000) to be achieved via the heat exchanger 204 (E-1001) and at the same time the glycol-based anti-freeze agent presence in the condensed water prevents hydrate and ice formations during the evaporative cooling. The MEG concentration shall be maintained between 70% to 75 wt %, to avoid freezing inside the Cold Separator 208 and downstream of the turbo-expander 206.
5. With further reference to FIG. 4, the separator 208 is fitted with appropriate internals for efficient three-phase separation and a heater 252 in a side vessel 262 through which the liquid is circulated by pump 260 for emulsion treatment. The emulsion forms due to the low temperature of the fluid as it enters the cold separator 208, but can be heated to above 15° C. through a tap-off line from the discharge of the compressor side of the turbo-expander 206 (KT-1000), at which temperature the oil separates from the water (and aqueous MEG) and floats on top thereof where it can tapped off by as condensate 246.
6. The cold fluid and anti-freeze agent from the separator 208 which is passed through the heat exchanger 204 (E-1001) is partially heated thereby to a temperature of around 35° C. without much drop in pressure to vaporize some amount of water from the MEG in order to obtain fairly lean MEG solution (80-85 wt %) in the recovery vessel 240 (V-1001).
7. The gas from the recovery vessel 240 (V-1001) is then routed to the downstream gas facilities 218 .
8. Fresh MEG may be added in the recovery vessel 240 from a lean source 256 whereafter the lean MEG is routed back for injection 242. The pressure of the MEG is increased to around 15 barg using a pump 258 to ensure that it can be injected i.e. it is at a higher pressure than the gas stream at the injection point.

Advantageously the LP-CRS system is supplied with feed gas at a pressure lower than its Cricondentherm pressure. In contrast to the conventional approach, the isentropic expansion takes place downstream of the cold separator to provide the chilling, resulting in a higher liquid drop-out from the gas. This is because the operating point has moved vertically deeper into the phase envelope (toward a higher quality line), thus resulting in higher amount of condensate recovery from the gas.

The expansion is paired with the evaporative cooling method by re-injecting separated condensed water to expanded-chilled-dry gases which is passed to an inlet gas-gas compact heat exchanger to achieve a deeper chilling. The operating point will move further horizontally deep into the phase envelope as the temperature is getting lower.

The LP-CRS system is designed in such a way that to have the operating point move deeper into the phase envelope, by chilling the gas at a higher pressure (<the Cricondentherm pressure).

It will be appreciated that in the current invention the MEG recovery is self-contained and integrated with the LP-CRS system. MEG recovery takes place downstream of the lean gas stream and only needs a recovery vessel with an optional condenser to prevent MEG loss—advantageously no reboiler is required, and there is no need for an external cold utility for the condenser. The recovered MEG water mixture has a sufficiently high MEG content (80 to 85 wt %) to work as a hydrate inhibitor.

Furthermore the current invention will see the MEG recovery system operating at a much lower temperature (<50° C.). This will mitigate the MEG degradation and fouling issue encountered by the conventional MEG recovery system which operate at high temperature (approx. 160° C.). MEG degradation temperature (163° C.) is based on reboiler heat flux of 12,000 BTU/ft2 which equates to a film temperature of 215° C.

MEG is the preferred antifreeze agent because:

- It has the lowest molecular weight in comparison with other glycols, and thus less amount is needed for the same extent of anti-freezing;
- It has lower viscosity than the other glycols at the same operating temperature, which has a higher pumpability at low temperature;
- It has an appreciably lower freezing point of its water solution compared to other glycols, which is suitable to act as hydrate inhibitor at deep cold condition; and
- It is less soluble in the condensed hydrocarbons than the other glycols, which will see a minimum loss of MEG in the recovery process.

Nevertheless, it should be appreciated that other agents could be used, such as monopropylene glycol (MPG).

Figure 5:
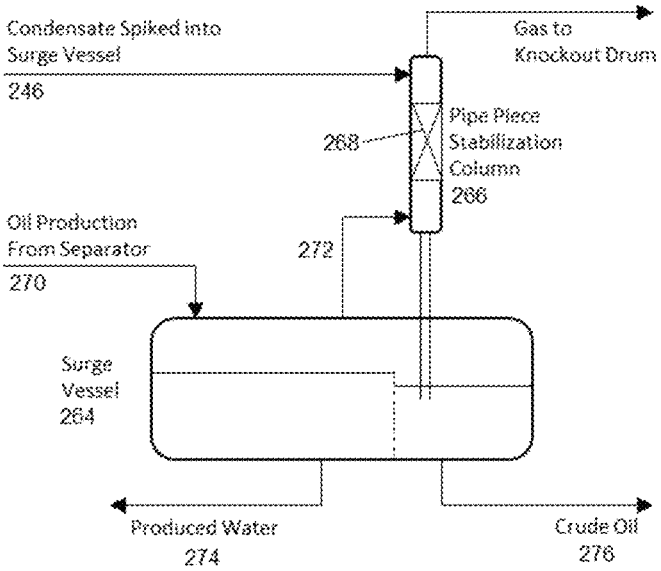
FIG. 5 illustrates a system for condensate spiking.

With regard to FIG. 5, the condensate 246 that is recovered from the LP-CRS is spiked back into the existing Surge Vessel 264, through a pipe-piece stabilization column 266 fitted with packing 268. The surge vessel 264 is a three phase separator for separating gas 272, water 274 and crude oil 276, operating at low pressure (e.g. 0.5 barg), receiving oil output 270 from an upstream separator operating at higher pressure (e.g. 10 barg). Therefore, the condensate will be stabilized through this pipe-piece as it passes down therethrough while the gas 272 from the surge vessel moves up therethrough, and commingles with the crude oil prior to storage in FPSO or exporting to pipeline. The pipe piece stabilization column strips off most of the lighter C3– components from the condensate and at the same time the condensate recovers a small amount of heavy ends from the gas leaving the existing Surge Vessel.

Besides that, spiking crude into crude oil improves the crude API gravity as well as improves flow assurance issue for fields facing with wax issues. The condensate that is recovered from the flare acts as a wax inhibitor which reduces the wax fraction in the crude.

It will be appreciated by persons skilled in the art that the present invention may also include further additional modifications made to the system which does not affect the overall functioning of the system.

The invention claimed is:

1. A system for recovering natural gas liquid from a gas source (210), comprising:

- compression means (206) for increasing the temperature and pressure of the fluid from the gas source;
- cooling means (230) for cooling the fluid from the compression means;
- at least one gas/gas heat exchanger (204), fluid from the cooling means flowing from a first inlet to a first outlet;
- at least one separator (208) for receiving the fluid from the first outlet of the at least one gas/gas heat exchanger (204) and separating liquid from the gas;
- the gas from the at least one separator being directed to expansion means (206) for reducing the temperature and pressure of the gas;
- wherein the liquid separated in the at least one separator comprises an aqueous part and a condensate, the condensate comprising hydrocarbons which are directed to an outlet for further treatment, the aqueous part comprising a liquid agent;
- the aqueous part of the liquid from the at least one separator and the gas from the expansion means being directed to the at least one gas/gas heat exchanger (204) where the liquid and the gas flow therethrough from a second inlet to a second outlet for cooling the fluid flowing between the first inlet and first outlet;
- wherein injection means are provided between the cooling means and the at least one gas/gas heat exchanger for saturating the gas with the liquid agent;
- characterised in that the liquid agent comprises an evaporant and an antifreeze agent; and
- a recovery vessel (240) is provided downstream of the second outlet, the antifreeze agent being recovered therein for injection into the fluid from the gas source upstream of the first inlet;
- wherein the expansion means and compression means are provided by respective sides of a turbo expander, and
- wherein the aqueous part of the liquid from the at least one separator and the gas from the expansion means is warmed by the at least one gas/gas heat exchanger as they flow from the second inlet to the second outlet such that the evaporant is absorbed by the gas thereby increasing recovery of the antifreeze agent.

2. The system according to claim 1 wherein the evaporant is water.

3. The system according to claim 1 wherein the antifreeze agent is monoethylene glycol or monopropylene glycol.

4. The system according to claim 1 wherein the at least one separator is provided with a heater for de-emulsifying the liquid in the at least one separator.

5. The system according to claim 4 wherein the heater is located in a separate vessel which receives liquid from the bottom of the at least one separator, warms the liquid, then returns the liquid to the at least one separator.

6. The system according to claim 1 wherein the cooling means is a seawater or air cooler, which does not significantly change the pressure of the fluid.

7. The system according to claim 1 wherein the at least one gas/gas heat exchanger comprises a series of heat exchangers and/or a multi-section heat exchanger comprising independent compartments within the same closure.

8. The system according to claim 1 wherein the condensate from the at least one separator is spiked into a surge vessel, provided for separating gas, water and oil at low pressure, the condensate being directed through a column of material through which gas from the surge vessel passes in the opposite direction to strip off C3− components having 3 or less carbons from the condensate and recover heavy ends from the gas.

* * * * *